US005670011A

United States Patent [19]

Togawa et al.

[11] Patent Number: 5,670,011

[45] Date of Patent: Sep. 23, 1997

[54] APPARATUS AND METHOD FOR POLISHING WORKPIECE

[75] Inventors: Tetsuji Togawa; Norio Kimura, both of Fujisawa, Japan

[73] Assignee: Ebara Corporation, Tokyo, Japan

[21] Appl. No.: 643,099

[22] Filed: May 2, 1996

[30] Foreign Application Priority Data

May 2, 1995 [JP] Japan ..... 7-132853

[51] Int. Cl.[6] ..... B24B 7/22

[52] U.S. Cl. ..... 156/345; 156/636.1; 216/88; 216/89; 451/41; 451/288

[58] Field of Search ..... 216/88, 89; 156/345, 156/636.1, 645.1; 451/41

[56] References Cited

U.S. PATENT DOCUMENTS 4,193,226 3/1980 Gill, Jr. et al. ..... 51/124 R 4,680,893 7/1987 Cronkhite et al. ..... 51/5 R 5,476,414 12/1995 Hirose et al. ..... 451/288

*Primary Examiner*—R. Bruce Breneman

*Assistant Examiner*—Michael E. Adjodha

*Attorney, Agent, or Firm*—Wenderoth, Lind & Ponack

[57] ABSTRACT

A workpiece such as a semiconductor wafer is polished to a flat mirror finish. The workpiece is held by a top ring, and a lower surface of the workpiece is polished by pressing the workpiece against an abrasive cloth mounted on a turntable while applying an abrasive solution onto the abrasive cloth. While the workpiece is being polished, an upper surface of the semiconductor wafer is prevented from being etched by supplying a neutralizer between the upper surface of the semiconductor wafer and the holding surface of the top ring.

9 Claims, 4 Drawing Sheets

APPARATUS AND METHOD FOR POLISHING WORKPIECE

BACKGROUND OF THE INVENTION

1. Field of the Invention

The present invention relates to an apparatus and method for polishing a workpiece, and more particularly to an apparatus and method for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnections is photolithography. Though the photolithographic process can form interconnections that are at most 0.5 μm wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus.

Conventionally, a polishing apparatus has a turntable and a top ring which rotate at respective individual speeds. An abrasive cloth is attached to the upper surface of the turntable. A workpiece such as a semiconductor wafer to be polished is placed on the abrasive cloth and clamped between the top ring and the turntable. During operation, the top ring exerts a constant pressure on the turntable, and a slurry-like abrasive solution containing abrasive grains is supplied from a nozzle over the abrasive cloth. The abrasive solution is retained on the abrasive cloth. The lower surface of the workpiece held against the abrasive cloth is therefore polished to a flat mirror finish while the top ring and the turntable are rotating.

The abrasive solution used in the conventional polishing apparatus contains abrasive grains, such as silicon dioxide ($SiO_2$), cerium dioxide ($CeO_2$) or alumina ($Al_2O_3$), which are suspended in an alkali solution such as potassium hydroxide (KOH) or sodium hydroxide (NaOH). In case of polishing semiconductor wafers which have metal interconnections made of tungsten (W), aluminum (Al) or copper (Cu), a specific abrasive solution such as a strong acid abrasive solution or strong alkali abrasive solution is used. In this case, the semiconductor wafer is polished by a combined polishing action of a mechanical polishing action caused by the abrasive grains contained in the abrasive solution and a chemical etching action caused by the alkali solution or acid solution.

However, in the conventional polishing apparatus, since the alkali abrasive solution or acid abrasive solution has been used, the abrasive solution enters between the holding surface (lower surface) of the top ring and the semiconductor wafer, and the upper surface of the semiconductor wafer is etched by alkali or acid. Similarly, the holding surface of the top ring is etched by alkali or acid.

SUMMARY OF THE INVENTION

It is therefore an object of the present invention to provide an apparatus and method for polishing a workpiece which can prevent a workpiece such as a semiconductor wafer and a holding surface of the top ring from being etched by an abrasive solution and polish the workpiece to a flat mirror finish.

According to a first aspect of the present invention, there is provided an apparatus for polishing a lower surface of a workpiece and including a turntable with an abrasive cloth mounted on an upper surface thereof, a top ring disposed above the turntable and having a holding surface for holding a workpiece to be polished and pressing the workpiece against the abrasive cloth, and a nozzle for supplying an abrasive solution onto the abrasive cloth. A plurality of openings are formed in the top ring and are open at the holding surface of the top ring. A neutralizer supply source communicates with the openings of the top ring for supplying a neutralizer between an upper surface of the workpiece and the holding surface of the top ring to prevent the upper surface of the workpiece from being etched by the abrasive solution.

According to a second aspect of the present invention, there is provided a method for polishing a lower surface of a workpiece and including: holding a workpiece by a holding surface of a top ring, polishing the lower surface of the workpiece by pressing the workpiece against an abrasive cloth mounted on a turntable while applying an abrasive solution onto the abrasive cloth, and supplying a neutralizer from openings of the top ring between an upper surface of the workpiece and the holding surface of the top ring to prevent the upper surface of the workpiece from being etched by the abrasive solution.

In a preferred aspect of the present invention, there is provided a vacuum source communicating with the openings of the top ring for holding the workpiece by the holding surface of the top ring under vacuum, and a pressurized liquid source communicates with the openings of the top ring for supplying a pressurized liquid to the openings of the top ring to remove the workpiece from the holding surface of the top ring.

In a preferred aspect of the present invention, there is provided a pressurized gas source communicating with the openings of the top ring for supplying a pressurized gas to the openings of the top ring to discharge liquid remaining in the openings and a passage connected to the openings.

According to the present invention, the workpiece can be held by the holding surface of the top ring under vacuum by causing the openings of the top ring to communicate with the vacuum source. During polishing, the upper surface of the workpiece and the holding surface of the top ring can be prevented from being etched by supplying a neutralizer, which neutralizes an alkali component or acid component in the abrasive solution, from the openings of the top ring to between the semiconductor wafer and the holding surface of the top ring. After polishing, the workpiece can be reliably removed from the holding surface of the top ring by ejecting liquid from the openings of the top ring. Further, any liquid remaining in the openings and a passage communicating with the openings can be discharged by supplying a pressurized gas such as a pressurized air to the openings and the passage.

The above and other objects, features and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
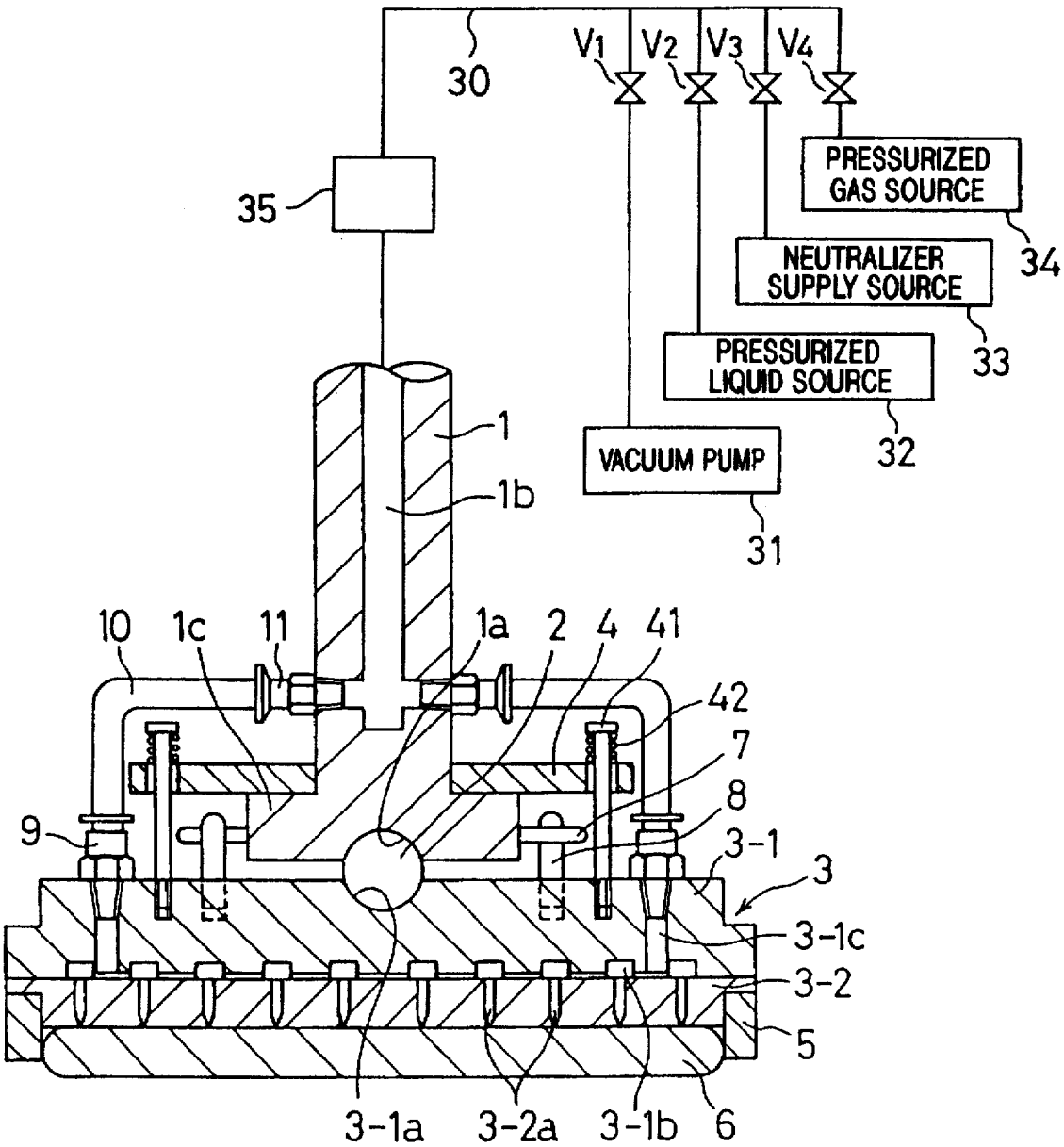
FIG. 1 is a cross-sectional view of a polishing unit of a polishing apparatus according to an embodiment of the present invention.
Figure 2:
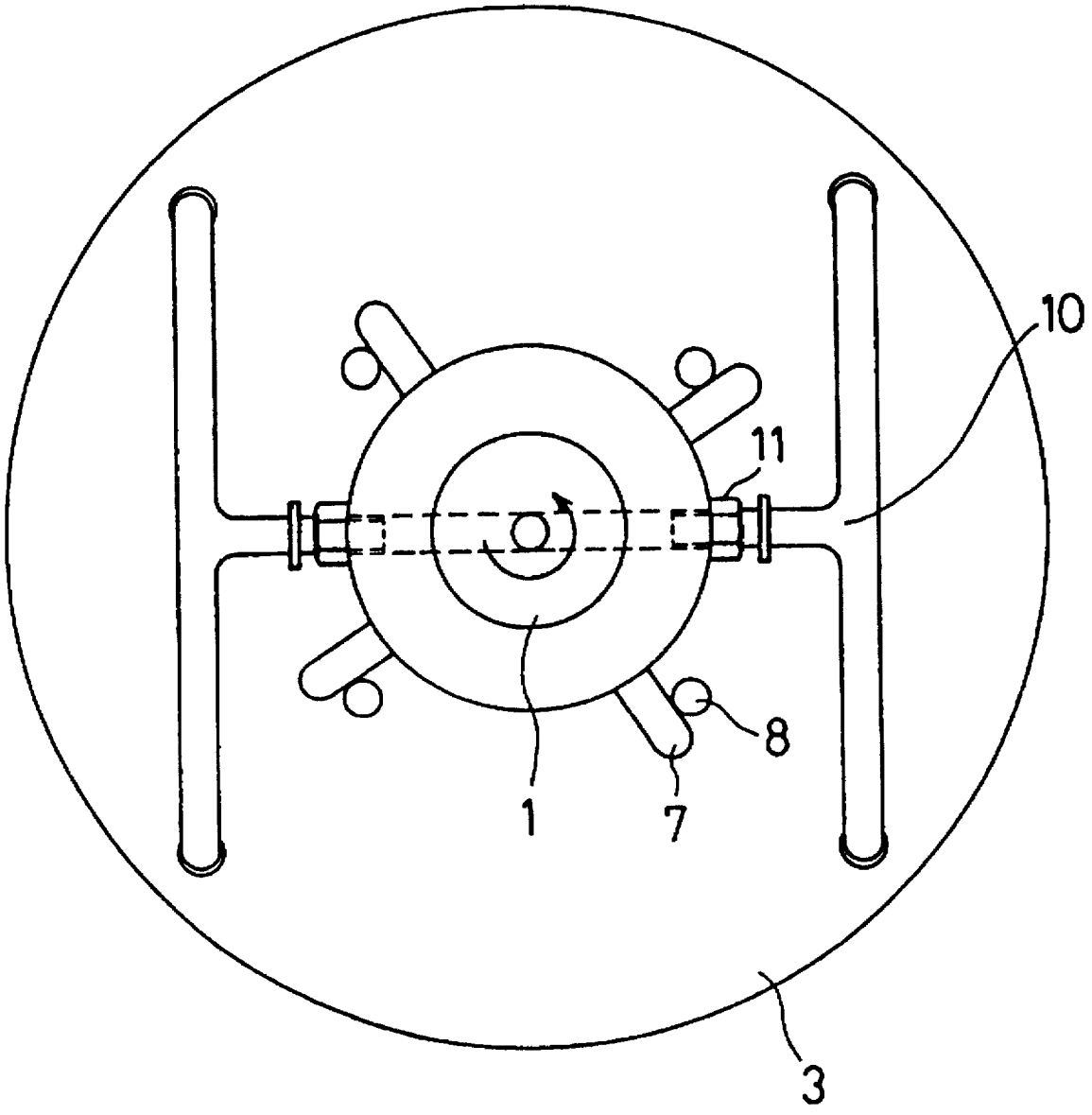
FIG. 2 is a plan view of the polishing unit shown in FIG. 1.

As shown in FIGS. 1 and 2, a polishing unit of a polishing apparatus according to the present invention comprises a vertical top ring drive shaft 1, a top ring 3 and a spherical bearing 2 interposed between the top ring drive shaft 1 and the top ring 3. The top ring drive shaft 1 has a central spherical concave surface 1*a* formed in a lower end thereof and held in sliding contact with the spherical bearing 2. The top ring 3 comprises an upper top ring member 3-1 and a lower top ring member 3-2 attached to the lower surface of the upper top ring member 3-1. The upper top ring member 3-1 has a central spherical concave surface 3-1*a* formed in an upper surface thereof and held in sliding contact with the spherical bearing 2. A wafer retaining ring 5 is mounted on a lower surface of the lower top ring member 3-2 along its outer circumferential edge.

The lower top ring member 3-2 has a plurality of openings 3-2*a* which are open at the lower surface of the lower top ring member 3-2. The upper top ring member 3-1 has a plurality of communicating grooves 3-1*b* formed therein and communicating with the openings 3-2*a*, respectively, and a plurality of communicating holes 3-1*c* (four in the illustrated embodiment) formed therein and communicating with the communicating grooves 3-1*b*. The communicating holes 3-1*c* are connected through tube couplings 9, vacuum line tubes 10, and tube couplings 11 to a central communicating hole 1*b* formed axially centrally in the top ring drive shaft 1.

The communicating hole 1*b* is connected through a rotary joint 35 and a pipe 30 to a vacuum pump 31, a pressurized liquid source 32, a neutralizer supply source 33 and a pressurized gas source 34. Valves V1, V2, V3 and V4 are provided in the vicinity of the vacuum pump 31, the pressurized liquid source 32, the neutralizer supply source 33 and the pressurized gas source 34, respectively.

The top ring drive shaft 1 has a radially outwardly extending flange 1*c* on its lower end. A plurality of torque transmission pins 7 (four in the illustrated embodiment) are provided on the outer periphery of the flange 1*c*. The upper surface of the upper top ring member 3-1 has a plurality of torque transmission pins 8 (four in the illustrated embodiment) projecting upwardly for point contact with the torque transmission pins 7, respectively. As shown in FIG. 2, when the top ring drive shaft 1 is rotated about its own axis in the direction indicated by the arrow, the torque transmission pins 7 are held in point contact with the torque transmission pins 8 to cause the top ring 3 to rotate.

Figure 3:
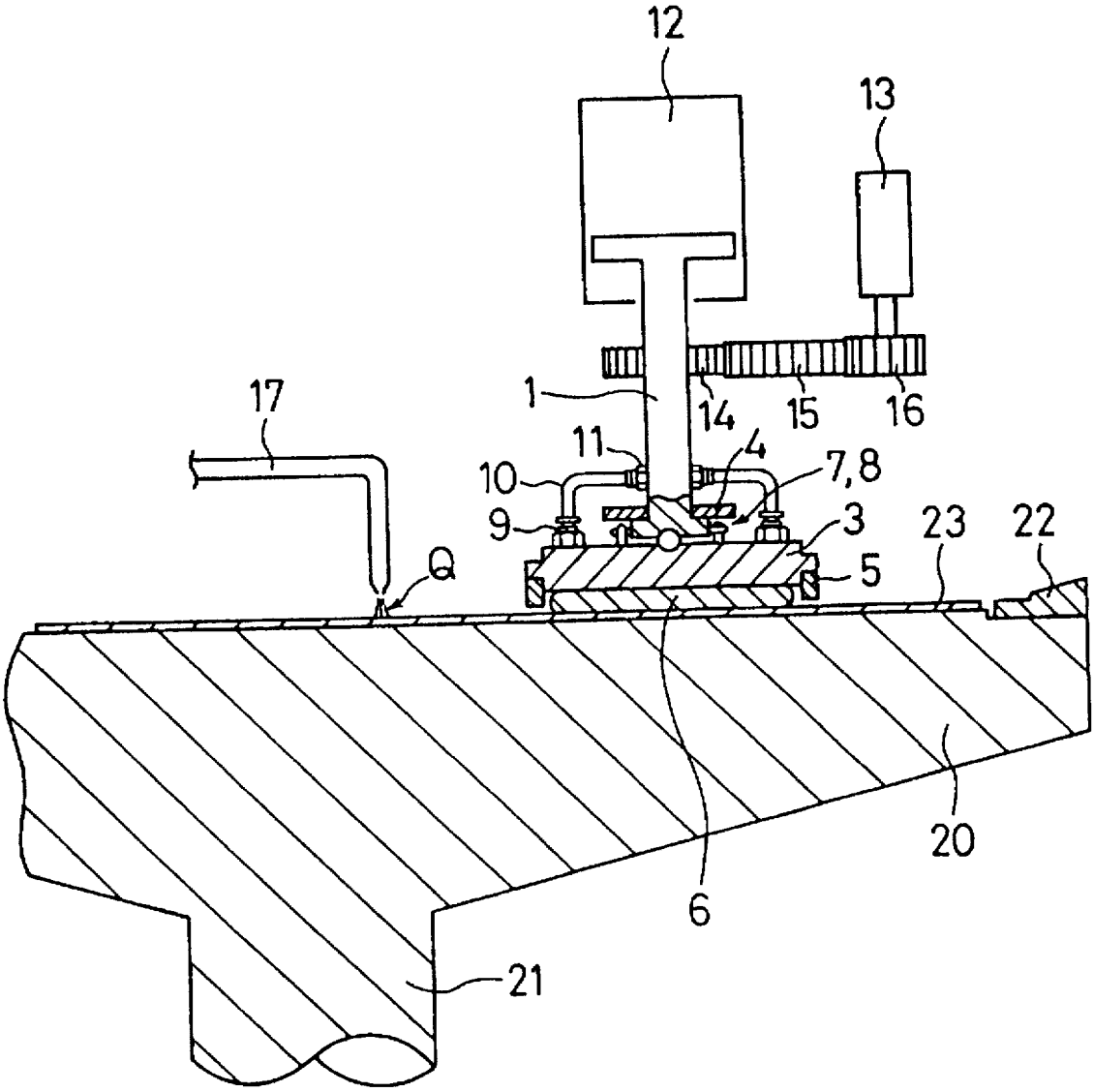
FIG. 3 is a cross-sectional view showing an entire structure of the polishing apparatus according to an embodiment of the present invention.

A semiconductor wafer 6 to be polished by the polishing apparatus is accommodated in a space defined between the lower surface of the lower top ring member 3-2, the inner circumferential edge of the wafer retaining ring 5, and the upper surface of a turntable 20 (see FIG. 3). The lower surface of the lower top ring member 3-2 constitutes a holding surface of the top ring. The turntable 20 has an abrasive cloth 23 mounted on its upper surface for polishing the lower surface of the semiconductor wafer 6.

In operation, the turntable 20 is rotated and the top ring drive shaft 1 is rotated. The torque of the top ring drive shaft 1 is transmitted to the top ring 3 through point contact between the torque transmission pins 7, 8, thus rotating the top ring 3 with respect to the turntable 20. The lower surface of the semiconductor wafer 6 held by the top ring 3 is thus polished by the abrasive cloth 23 on the turntable 20 to a flat mirror finish.

A top ring holder 4 is mounted on the flange 1*c* of the top ring drive shaft 1 and fixed to the top ring 3 by a plurality of vertical bolts 41 which extend through the top ring holder 4 and are threaded into the upper top ring member 3-1. Compression coil springs 42 are interposed between the heads of the bolts 41 and the top ring holder 4 for normally urging the top ring holder 4 downwardly to press it against the flange 1*c*. When the top ring drive shaft 1 with the top ring holder 4, is elevated upwardly, the compression coil springs 42 serve to keep the top ring 3 horizontally, aligned thereby facilitating attachment and removal of the semiconductor wafer 6.

FIG. 3 shows the polishing apparatus which incorporates the polishing unit shown in FIGS. 1 and 2. As shown in FIG. 3, the turntable 20 is supported on a central shaft 21 and is rotatable about the axis of the shaft 21. A turntable ring 22 for preventing a slurry-like abrasive solution or the like from being scattered outwardly is mounted on the upper surface of the turntable 20 along an outer circumferential edge thereof. The abrasive cloth 23 is attached to the upper surface of the turntable 20 radially inwardly of the turntable ring 22.

The polishing unit shown in FIGS. 1 and 2 is located above the turntable 20. The top ring 3 is pressed against the turntable 20 under a constant pressure by a top ring cylinder 12 which houses a slidable piston that is connected to the upper end of the top ring drive shaft 1. The polishing apparatus also has a top ring motor 13 for rotating the top ring drive shaft 1 through a transmission mechanism comprising a gear 14 fixed to the top ring drive shaft 1, a gear 16 coupled to the output shaft of the top ring motor 13, and a gear 15 meshingly engaged with the gears 14, 16. An abrasive solution supply nozzle 17 is disposed above the turntable 20 for supplying an abrasive solution Q containing abrasive grains onto the abrasive cloth 23 on the turntable 20.

The polishing apparatus operates as follows: The semiconductor wafer 6 is held by the holding surface of the lower top ring member 3-2, and pressed against the abrasive cloth 23 on the turntable 20 by the top ring cylinder 12. At this time, the turntable 20 is being rotated by the shaft 21, and the top ring 3 is also being rotated by the top ring motor 13. Further, the abrasive solution Q is supplied from the abrasive solution supply nozzle 17 onto the abrasive cloth 23. The supplied abrasive solution Q is retained on the abrasive cloth 23, and the semiconductor wafer 6 is polished in contact with the abrasive cloth 23.

When the upper surface of the turntable 20 is slightly tilted during polishing of the semiconductor wafer, the top ring 3 is tilted about the spherical bearing 2 with respect to the top ring drive shaft 1. However, since the torque transmission pins 7 on the top ring drive shaft 1 are held in point-to-point contact with the torque transmission pins 8 on the top ring 3, the torque from the top ring drive shaft 1 can reliably be transmitted to the top ring 3 through the torque transmission pins 7, 8, though they may contact each other at different positions.

When the vacuum pump 31 is operated and the valve V1 is opened, the semiconductor wafer 6 is held by the top ring 3 under vacuum developed in the openings 3-2*a* communicating with the vacuum pump 31 through a vacuum line including the pipe 30, the communicating hole 1*b* and the valve V1. During polishing, a small amount of neutralizer is supplied between the semiconductor wafer 6 and the holding surface of the top ring 3 from the openings 3-2*a* communicating with the neutralizer supply source 33 through a neutralizer supply line including the pipe 30, the communicating hole 1*b* and the valve V3. A small amount of neutralizer flows on the upper surface of the semiconductor wafer 6, therefore the upper surface of the semiconductor wafer 6 is not etched by the abrasive solution during polishing. Since the amount of the neutralizer which flows on the upper surface of the semiconductor wafer 6 is extremely small, the polishing action of the abrasive solution is not affected by the neutralizer.

Further, in some types of the conventional polishing apparatus, an elastic pad is interposed between the top ring and the semiconductor wafer to uniformize a polishing pressure over the entire surface of the semiconductor wafer. In this case, by supplying the neutralizer between the elastic pad and the semiconductor wafer, the elastic pad and the upper surface of the semiconductor wafer are not etched by the abrasive solution.

After polishing, the semiconductor wafer 6 is held by the top ring 3 under vacuum, and then the top ring 3 is lifted and moved toward a predetermined position. At the predetermined position, the semiconductor wafer 6 is removed from the top ring 3. In this case, the semiconductor wafer 6 cannot be removed from the top ring 3 only by breaking vacuum because the semiconductor wafer 6 is strongly stuck to the holding surface of the top ring 3 by surface tension between the upper surface of the semiconductor wafer 6 and the holding surface of the top ring 3. Therefore, a certain amount of liquid such as deionized water having a certain pressure is supplied between the holding surface of the top ring 3 and the semiconductor wafer 6 from the openings 3-2*a* communicating with the pressurized liquid source 32 through a liquid supply line including the pipe 30, the communicating hole 1*b* and the valve V2. As a result, the semiconductor wafer 6 is removed from the top ring 3 with the injection of liquid.

After polishing, the top ring 3 is moved toward a top ring cleaning section where the holding surface of the top ring 3 is cleaned by being scrubbed with a brush while supplying a cleaning liquid such as water to the top ring 3. After cleaning, a pressurized gas such as a pressurized air is supplied to the openings 3-2*a* from the pressurized gas source 34 through a gas supply line including the pipe 30, the communicating hole 1*b* and the valve V4. Therefore, the liquid or the cleaning liquid remaining in the liquid supply line is discharged therefrom, and the vacuum pump 31 does not draw any liquid when a subsequent semiconductor wafer 6 is held by the top ring 3 under vacuum.

When cleaning the holding surface of the top ring 3, the cleaning liquid may be supplied from the openings 3-2*a* of the top ring 3 by mixing the cleaning liquid with the pressurized liquid in the pressurized liquid source 32. The neutralizer which is supplied between the semiconductor wafer 6 and the holding surface of the top ring 3 during polishing may preferably comprise solution containing sodium hypochlorite (NaClO) or citric acid when an alkali abrasive solution is used. The sodium hypochlorite is effective in preventing the generation of bacteria in the liquid supply line including the openings, the tubes, the pipe and the like.

Figure 4:
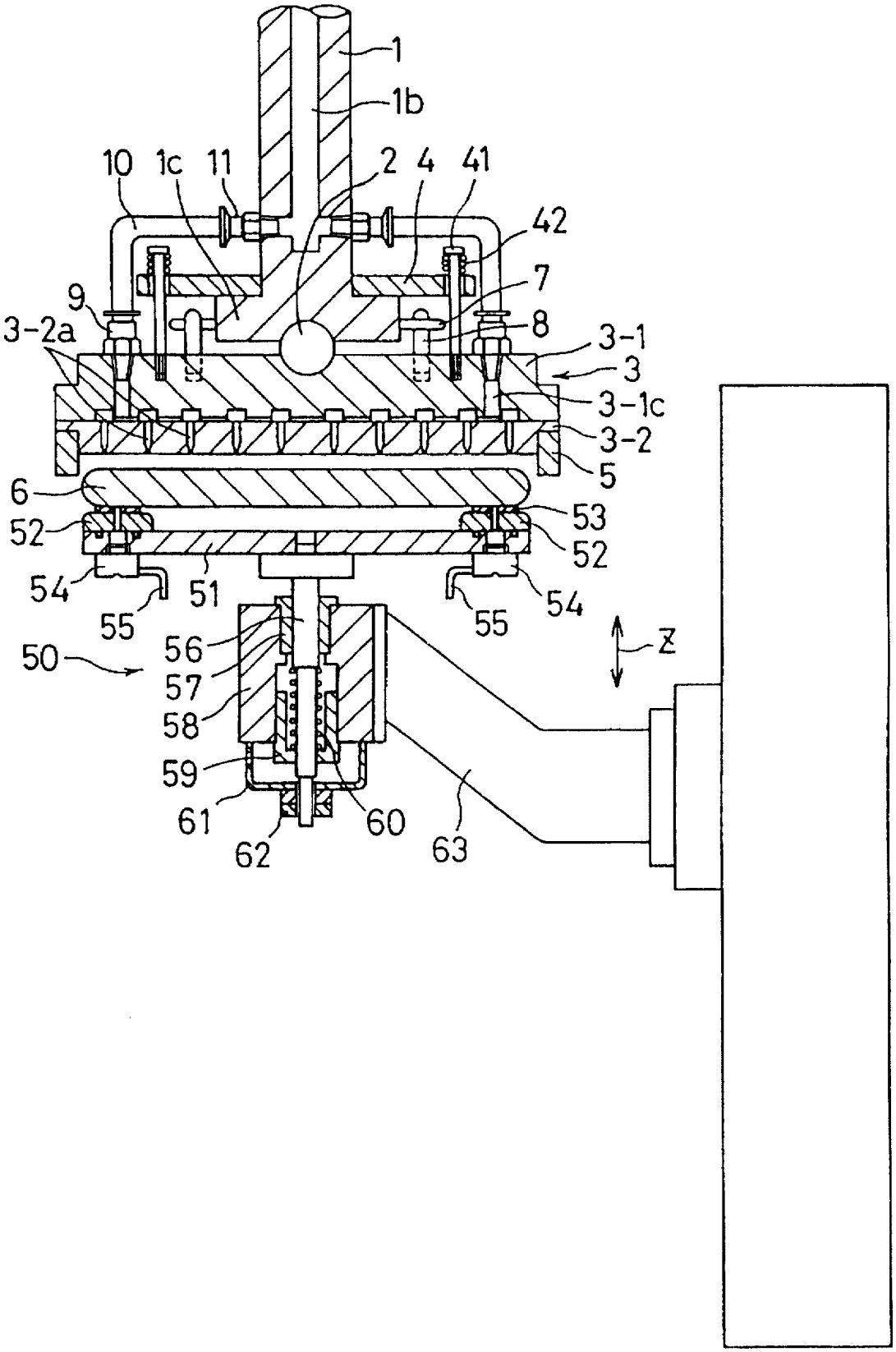
FIG. 4 is a cross-sectional view of a transferring device incorporated in the polishing apparatus according to the present invention.

Next, a transferring device 50 incorporated in the polishing apparatus for transferring a semiconductor wafer to and from the top ring will be described below with reference to FIG. 4. In FIG. 4, a disk-like base 51 has a plurality of supports 52 at the upper circumferential surface thereof. A pad 53 is attached to the upper surface of the supports 52. Suction holes are formed in the supports 52 and the pad 53, respectively. The suction holes of the support 52 and the pad 53 communicate with a vacuum line tube 55 through a coupling 54.

The base 51 is fixed to an upper end of a shaft 56 which is slidably supported by a sleeve-like bearing 57 fixed to a bearing housing 58. A spring 60 is interposed between the shaft 56 and a spring retainer 59 fixed to the bearing housing 58 so that the shaft 56 is urged upwardly. The outer periphery of spring retainer 59 has a male thread, which is threaded into a female thread formed in the bearing housing 58. Nuts 62 are threaded over the lower end of the shaft 56 and contact a stopper 61, and hence the shaft 56 is prevented from being lifted by the spring 60. The bearing housing 58 is fixed to a forward end of an arm 63 which is vertically movable by an elevator (not shown) as shown by the arrow Z in FIG. 4.

The transferring device 50 operates as follows: The semiconductor wafer 6 is placed on the pad 53, and attracted by the pad 53 when the vacuum line tube 55 communicates with a vacuum source (not shown). When a pressure such as an impact force is applied to the base 51 through the pad 53 and the support 52, the shaft 56 is lowered against the urging force of the spring 60. That is, the sleeve-like bearing 57, the bearing housing 58, the spring retainer 59 and the spring 60 jointly constitute a shock absorber.

After polishing, the semiconductor wafer 6 is removed from the top ring 3, and transferred to the transferring device 50. The transferring device 50 which holds the semiconductor wafer 6 is stopped at the position where a small distance is formed between the holding surface of the top ring and the upper surface of the semiconductor wafer 6. The distance between the holding surface of the top ring 3 and the upper surface of the semiconductor wafer is a several mm. The pressurized liquid is ejected from the openings 3-2*a* of the top ring 3 while maintaining the above distance between the holding surface of the top ring 3 and the upper surface of the semiconductor wafer 6. Since there is only a small distance between the holding surface of the top ring 3 and the upper surface of the semiconductor wafer 6, the ejected liquid from the openings 3-2*a* cleans the upper surface of the semiconductor wafer 6 and the holding surface of the top ring 3 located above the semiconductor 6, simultaneously.

After performing a cleaning process of the semiconductor wafer 6 for a certain period of time, the polished semiconductor wafer 6 is transported to a next process by the transferring device 50, and the top ring 3 having the holding surface which has been cleaned holds a subsequent semiconductor wafer to be polished.

While ejecting liquid from the openings 3-2*a* of the top ring 3, cleaning is effectively performed by rotating the top ring 3. It is preferable that when the holding surface of the top ring 3 and the upper surface of the semiconductor wafer 6 are cleaned, deionized water is supplied to the polished surface of the semiconductor wafer 6 to prevent the polished surface from being dried. That is, the abrasive solution on the polished surface of the semiconductor wafer 6 is prevented from being dried and adhering thereto.

In the above embodiment, although a semiconductor wafer is described as a workpiece, the workpiece is not limited to a semiconductor wafer and can include a glass substrate, a liquid crystal panel, or the like. The workpiece can include a semiconductor wafer having metal interconnections at the surface thereof, a semiconductor wafer having a silicon oxide layer on the metal interconnections, a bare silicon wafer, and a semiconductor wafer having a dielectric layer such as a silicon oxide layer on bare silicon.

As is apparent from the above description, according to the present invention, the workpiece can be held by the holding surface of the top ring under vacuum by causing the openings of the top ring to communicate with the vacuum source. During polishing, the upper surface of the workpiece and the holding surface of the top ring can be prevented from being etched by supplying a neutralizer which neutralizes an alkali component or acid component in the abrasive solution, from the openings of the top ring between the semiconductor wafer and the holding surface of the top ring. After polishing, the workpiece can be reliably removed from the holding surface of the top ring by ejecting liquid from the openings of the top ring. Further, the liquid remaining in the openings and a passage communicating with the openings can be discharged by supplying a pressurized gas such as a pressurized air to the openings and the passage.

Although a certain preferred embodiment of the present invention has been shown and described in detail, it should be understood that various changes and modifications may be made therein without departing from the scope of the appended claims.

What is claimed is:

1. An apparatus for polishing a lower surface of a workpiece, said apparatus comprising:

a turntable with an abrasive cloth mounted on an upper surface thereof;

a top ring disposed above said turntable and having a holding surface for holding a workpiece to be polished and pressing the workpiece against said abrasive cloth;

a nozzle for supplying an abrasive solution onto said abrasive cloth;

a plurality of openings formed in said top ring and being open at said holding surface of said top ring; and a neutralizer supply source communicating with said openings of said top ring for supplying a neutralizer between an upper surface of the workpiece and said holding surface of said top ring to prevent the upper surface of the workpiece from being etched by said abrasive solution.

2. An apparatus according to claim 1, further comprising a vacuum source communicating with said openings of said top ring for holding the workpiece by said holding surface of said top ring under vacuum; and a pressurized liquid source communicating with said openings of said top ring for supplying a pressurized liquid to said openings of said top ring to remove the workpiece from said holding surface of said top ring.

3. An apparatus according to claim 1, further comprising a pressurized gas source communicating with said openings of said top ring for supplying a pressurized gas to said openings of said top ring to discharge liquid remaining in said openings and a passage connected to said openings.

4. An apparatus according to claim 2, further comprising a pressurized gas source communicating with said openings of said top ring for supplying a pressurized gas to said openings of said top ring to discharge liquid remaining in said openings and a passage connected to said openings.

5. An apparatus for polishing a lower surface of a workpiece, said apparatus comprising:

a turntable with an abrasive cloth mounted on an upper surface thereof;

a top ring disposed above said turntable and having a holding surface for holding a workpiece to be polished and pressing the workpiece against said abrasive cloth;

a nozzle for supplying an abrasive solution onto said abrasive cloth;

a plurality of openings formed in said top ring and being open at said holding surface of said top ring;

a pressurized liquid source communicating with said openings of said top ring for supplying a pressurized liquid to said openings of said top ring;

a transferring device for receiving the workpiece from said top ring with a space between said holding surface of said top ring and an upper surface of the workpiece;

at least one outlet for directing cleaning liquid into said space to simultaneously clean said holding surface of said top ring and the upper surface of the workpiece; and said top ring and said transferring device being relatively movable to enable creation of said space sufficient to enable said simultaneous cleaning to be carried out.

6. An apparatus according to claim 5, wherein said at least one outlet comprises said plurality of openings in said top ring that open at said holding surface thereof.

7. A method for polishing a lower surface of a workpiece, said method comprising the steps of:

holding a workpiece by a holding surface of a top ring;

polishing the lower surface of the workpiece by pressing the workpiece against an abrasive cloth mounted on a turntable while applying an abrasive solution onto said abrasive cloth; and supplying a neutralizer from openings of said top ring between an upper surface of the workpiece and said holding surface of said top ring to prevent said upper surface of the workpiece from being etched by said abrasive solution.

8. A method according to claim 7, further comprising the steps of:

removing the workpiece from said top ring by supplying a pressurized liquid to said openings of said top ring; and discharging liquid remaining in said openings of said top ring and a passage connected to said openings by supplying a pressurized gas to said openings of said top ring.

9. A method according to claim 8, further comprising the step of cleaning said upper surface of the workpiece and said holding surface of said top ring simultaneously by supplying a cleaning liquid from said top ring to said upper surface of the workpiece in such a state that a small distance is formed between said holding surface of said top ring and said upper surface of the workpiece.

* * * * *